US006976422B2

(12) United States Patent
Haberstroh et al.

(10) Patent No.: US 6,976,422 B2
(45) Date of Patent: Dec. 20, 2005

(54) STRAPPING MACHINE WITH AUTOMATIC STRAP CLEARING AND RELOADING

(75) Inventors: James A. Haberstroh, Vernon Hills, IL (US); Timothy B. Pearson, Antioch, IL (US); John A. Rometty, Barrington, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 152 days.

(21) Appl. No.: 10/456,616

(22) Filed: Jun. 6, 2003

(65) Prior Publication Data

US 2004/0244606 A1 Dec. 9, 2004

(51) Int. Cl.[7] ..... B65B 13/04; B65B 11/00

(52) U.S. Cl. ..... 100/6; 100/26; 100/29; 53/589; 53/590

(58) Field of Search ..... 100/1, 4, 6, 8, 100/26, 29, 32, 33 R, 33 PB; 53/582, 589, 53/590; 226/25, 194, 188–192

(56) References Cited

U.S. PATENT DOCUMENTS 4,145,963 A * 3/1979 Leslie et al. ..... 100/4
5,287,802 A * 2/1994 Pearson ..... 100/4
5,640,899 A * 6/1997 Bell et al. ..... 100/2

* cited by examiner

*Primary Examiner*—Derris H. Banks
*Assistant Examiner*—Shelley Self
(74) *Attorney, Agent, or Firm*—Mark W. Croll, Esq.; Donald J. Breh, Esq.; Welsh & Katz, Ltd.

(57) ABSTRACT

A clearing and reloading assembly is configured for use with a strapping machine of the type having an infeed arrangement at about a strap material inlet to the machine, a feed assembly and a chute, the strapping machine defining a strap material holding region between the infeed arrangement and the feed assembly. The strapping machine is configured to receive first and second courses of associated strap material, position, tension and seal the strap material around a load. The clearing and reloading assembly includes a body, a driven wheel and a bearing element opposite of the driven wheel. The bearing element and the driven wheel define a strap path therebetween. A strap cutter is disposed for movement into and out of the strap path. A first peripheral portion of the driven wheel is configured to define a gap between the first portion and the bearing element such that the strap material can slip therebetween. A second peripheral portion of the driven wheel is configured such that the strap material is gripped between the second portion and the bearing element, and a third peripheral portion of the driven wheel is configured such that the strap material is pinched between third portion and the bearing element. The cutter is movable into the strap path to sever the strap material.

22 Claims, 2 Drawing Sheets

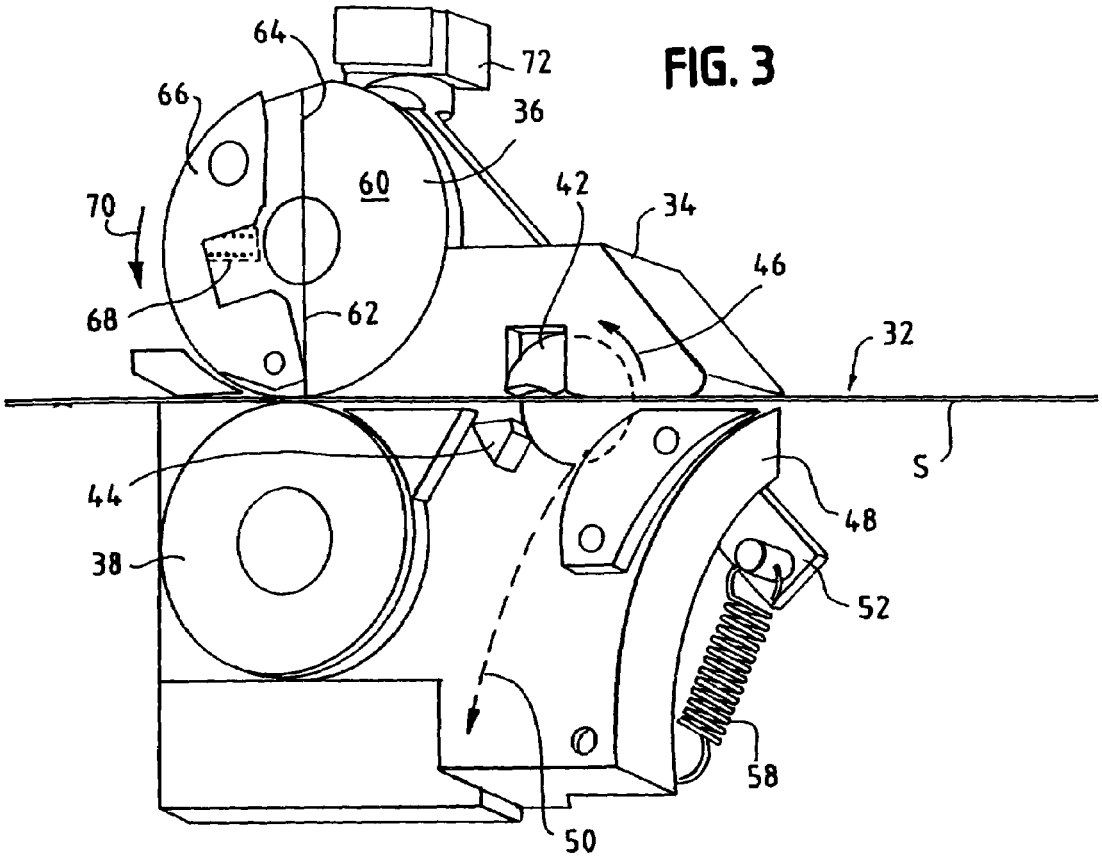
FIG. 3
FIG. 4
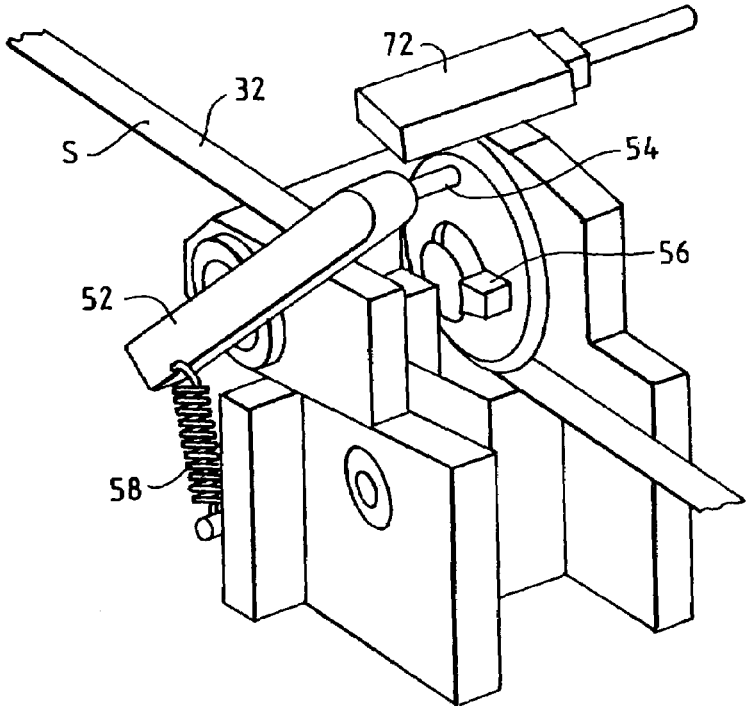

STRAPPING MACHINE WITH AUTOMATIC STRAP CLEARING AND RELOADING

BACKGROUND OF THE INVENTION

The present invention is directed to an improvement in a strapping machine. More particularly, the present invention is directed to a strapping machine having an automatic strap clearing and reloading assembly for severing and clearing misfed strap from between the infeed wheels and the strapping head and for refeeding the strap into the infeed wheels.

Strapping machines are in widespread use for securing straps around loads. One type of known strapper is a stationary unit that includes a strapping head and drive mechanism mounted within a frame. A chute is mounted to the frame, through which the strapping material is fed. In a typical arrangement, a table-top or work surface is likewise mounted to the frame.

In a typical stationary strapper, the chute is mounted from about the work surface, and the strapping head is mounted below the work surface. Strap is fed from a source or dispenser to the strapping or welding head. The strapping head provides a number of functions. First, it includes a plurality of grippers for gripping portions of the strap during the course of a strapping operation. The strapping head also includes a cutter to cut the strap from a strap source or supply. Last, the strapping head includes a sealer to seal an overlying course of strapping material onto itself. This seal is commonly referred to as a weld and is effected by heating overlying courses of the strap by use of a vibrating element.

Strapping material is fed from the dispenser into the strapping head first via a pair of infeed wheels and second via a feed assembly. The infeed wheels are typically located immediately inside of the strapping machine (e.g., inside of an enclosure or cabinet). The infeed wheels facilitate smoothly feeding the strapping material into the strapper and further supply strapping material into the slack box. The slack box is an area between the infeed wheels and the strapping head that is used to store a length of "slack" strapping material for use by the strapping head and is also an area for storing take-up strap that has been rewound or tensioned around the load.

In that many strapping operations are generally ancillary to some other operation, such as a manufacturing operation, it is desirable to maintain the strapping operation as a fully or semi-automated process. To this end, it is also desirable to have any malfunctions, misfeeds and the like self-corrected by the strapping machine.

One known strapping machine includes a strapping head that serves a dual function that includes, beyond the typical strap sealing and severing operations, that of ejecting misfed strap and refeeding strap material into the strapping head. Such an arrangement is disclosed in Bell et al., U.S. Pat. No. 5,640,899, which patent is commonly assigned with the present application and is incorporated herein by reference.

Unfortunately, the arrangement disclosed in the aforementioned patent to Bell et al., serves only to eject misfed strap from the strap path from the strapping head, around the strap chute and back to the strapping head. Misfed strap prior to the strapping head (e.g., between the dispenser and the strapping head), must be manually pulled from the machine, as by an operator, and refed to the strapping machine.

Accordingly, there is a need for a strapping machine having an automatic strap clearing and reloading assembly. Desirably, such a clearing and reloading assembly severs and clears misfed strap from between the infeed wheels and the strapping head and refeeds the strap into the infeed wheels. Most desirably, such an assembly directs that ejected strap away from the strap path so that reloading is readily accomplished without interference.

BRIEF SUMMARY OF THE INVENTION

A clearing and reloading assembly is configured for use with a strapping machine of the type having an infeed arrangement at about a strap material inlet to the machine, a feed assembly and a chute. The strapping machine defines a strap material holding region between the infeed arrangement and the feed assembly. The machine is configured to receive first and second courses of associated strap material, position, tension and seal the strap material around a load.

The clearing and reloading assembly severs and clears misfed strap from between the infeed wheels and the strapping head and refeeds the strap into the infeed wheels. Such an assembly directs the ejected strap away from the strap path so that reloading is readily accomplished without interference.

The clearing and reloading assembly includes a body, a driven wheel and a bearing element opposite of the driven wheel. The bearing element and the driven wheel define a strap path therebetween. A strap cutter is disposed for movement into and out of the strap path.

A first peripheral portion of the driven wheel is configured to define a gap between the first portion and the bearing element such that the strap material can slip therebetween. A second peripheral portion of the driven wheel is configured such that the strap material is gripped between the second portion and the bearing element. A third peripheral portion of the driven wheel is configured such that the strap material is pinched between third portion and the bearing element.

The cutter is movable into the strap path to sever the strap material. Preferably, the second portion of the driven wheel engages the strap material to secure the strap material between the driven wheel and the bearing element when the cutter severs the strap material to prevent slipping of the strap material.

In a current embodiment, the second peripheral portion of the driven wheel is formed as a movable gripping portion movable in a radial direction. The movable gripping portion is outwardly radially biased. The bearing element can be configured as an idler wheel.

Preferably, the strap cutter is rotatably moveable into and out of the strap path. The machine can include a strap guide such that movement of the strap cutter into and beyond the strap path defines a strap material ejection path in conjunction with the strap guide.

A cutter engaging member or arm can be operably connected to the cutter for moving the strap cutter into and out of the strap path. The engaging member can be configured to engage the driven wheel for moving the strap cutter into and out of the strap path.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein:

FIG. 3 is a perspective illustration of the front of the clearing and reloading assembly shown the in home or open position; and FIG. 4 is a perspective illustration of the rear of the clearing and reloading assembly.

DETAILED DESCRIPTION OF THE INVENTION

Figure 1:
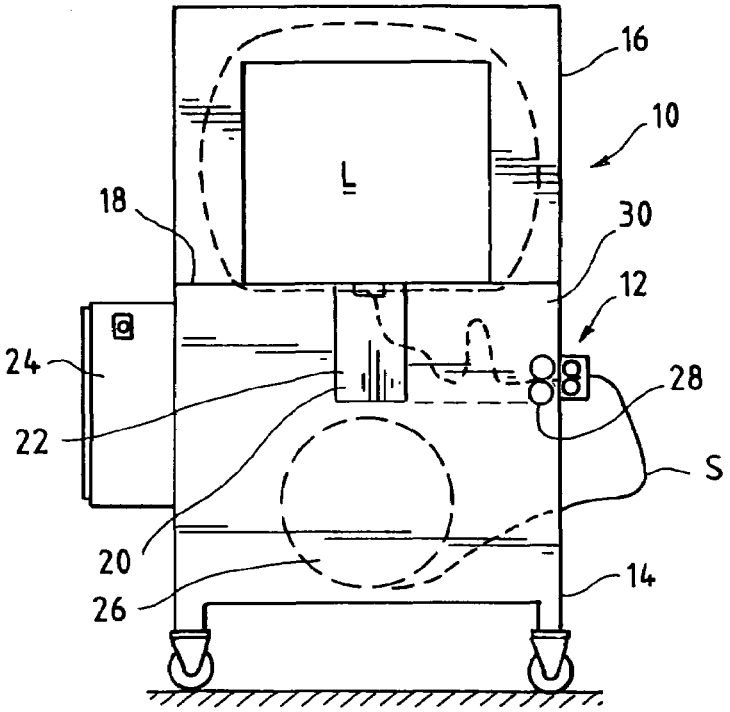
FIG. 1 is a front view of an exemplary strapping machine having an automatic clearing and reloading assembly embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring to the figures and in particular FIG. 1, there is shown a strapping machine 10 having an automatic strap clearing and reloading assembly 12 embodying the principles of the present invention. The strapping machine 10 includes, generally, a frame 14, a strap chute 16 and a table top or work surface 18. A feed assembly 20 and a strapping head 22 are mounted below the work surface 18. A controller 24 provides automatic operation and control of the strapper 10.

The strapping head 22 receives strapping material S from a dispenser 26. The strap S is fed or pulled from the dispenser 26 by infeed wheels 28. In a typical arrangement, the infeed wheels 28 are mounted immediately inside of and within the machine 10. The feed assembly 20 (which may include one or two pairs of wheels) feeds strapping material S into the strapping head 22 (for conveyance around the chute 16), and takes-up or tensions the strapping material S around the load L. The region between the feed assembly 20 or feed wheels and the infeed wheels 28 defines a slack box 30. The slack box 30 is used as a "storage" region for the strap S that has been fed into the machine 10 but has not yet been pulled into the strapping head 22, and for strap S that has been taken-up from around the load L, as during tensioning.

It has been found that, at times, the strap S within the slack box 30, and in areas prior to the strapping head 22 can be misfed, thus requiring removal from the machine 10 and refeeding into the machine 10. Presently, such an operation is carried out manually. That is, an operator must physically pull the strap from the machine, cut the strap (if necessary), and refeed the strap into the machine. This can be a time consuming operation, and, although it may not be a labor intensive operation, until an operator is available to carryout the manual clearing and refeeding, valuable operating time can be lost.

Figure 2:
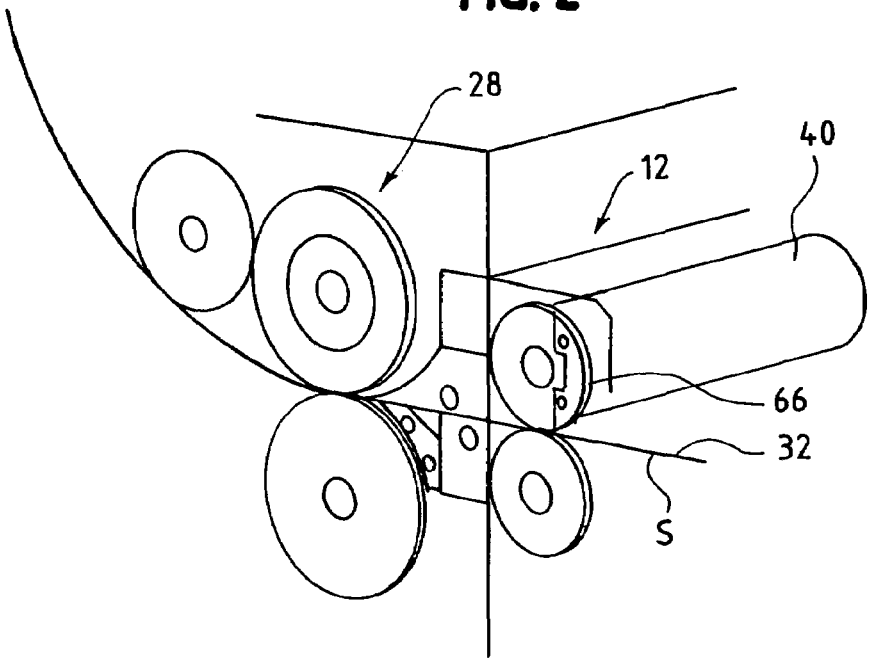
FIG. 2 is a perspective illustration of the clearing and reloading assembly mounted to the strapping machine and showing the relative positioning of the clearing and reloading assembly and the strapping machine infeed wheels.

Referring to FIGS. 2–4, the present automatic strap clearing and reloading assembly 12 severs and clears misfed strap S from between the infeed wheels 28 and the strapping head 22 and refeeds the strap S into the infeed wheels 28. Advantageously, such an assembly 12 directs the ejected strap away from the strap path (as indicated generally at 32) so that reloading is readily accomplished without interference.

The clearing and reloading assembly 12 includes a body 32 having a pair of wheels, 36, 38, one of which 36 is driven (as by a motor 40) and the other of which 38 is an idler or pinch wheel to facilitate driving the strap S. The driven wheel 36 has a varying diameter so that, as will be described below, at points in the rotation of the wheel 36, the strap S slips between the driven 36 and idler 38 wheels and at other points in the rotation of the wheel 36, the wheels 36, 38 grip the strap S and at still other points in the rotation of the wheel 36, the wheels 36, 38 move the strap S between the driven 36 and idler 38 wheels.

The assembly 12 includes a rotating cutter 42 and a fixed cutter 44 along the strap path 32. The rotating cutter 42 rotates (as indicated by the arrow at 46 in FIG. 3) into the strap path 32 (when the assembly 12 is actuated) to sever the strap S (between the rotating 42 and fixed cutters 44) and rotates out of the strap path 32. In this manner, the cutters 42, 44 define a portion of the strap path 32. A strap guide 48 is located downstream of the fixed cutter 44 and, along with the rotating cutter 42 (when in the severing position), defines an ejected strap path, as indicated by the phantom line at 50.

The rotating cutter 42 is mounted to the body 34 by a cutter drive lever 52. The lever 52 is moved (pivoted) about an axis $A_{52}$. The cutter 42 lies adjacent the axis $A_{52}$ and rotates by contact of a finger 54 on the lever 52 with an engaging shoulder 56 on the driven wheel 36. The cutter 42 is biased to a home position (the open strap path position, as illustrated in FIG. 3) by a spring 58, such as the illustrated coil spring, mounted to the drive lever 52 and the body 34.

As set forth above, the driven wheel 36 has a varying diameter. This is provided by an out-of-round wheel frame or body 60 having a first, smallest diameter (indicated generally at 62) and a third, largest diameter (indicated generally at 64). A second, intermediate diameter is provided by a biased, movable gripper portion 66. In a present wheel 36, the gripper 66 pivots about the wheel body 60 and the bias is provided by a spring 68 fitted between the gripper portion 66 and the body 60.

As will be appreciated from the figures, when the portion of the wheel at the first diameter 62 is facing the strap S, the strap S can "slip" between the driven wheel 36 and the pinch wheel 38. When the portion of the wheel at the second diameter (at the gripper portion 66) is in contact with the strap S, the strap S is held or gripped between the wheels 36, 38, without movement of the strap S either way, and when the portion of the driven wheel at the third diameter 64 is in contact with the strap S, the force of the wheel 36 against the strap S (which is pinched against the pinch wheel 38) is sufficient to drive the strap S when the wheel 36 rotates. It should be noted that when the strap S is "gripped" by the gripper 66, even as the wheel 36 rotates, the strap S is held stationary by the gripper 66.

In operation, the clearing and reloading assembly 12 is in the home position (FIG. 3) with the cutter 42 rotated out of the strap path 32 and with the driven wheel 36 in position such that the first diameter portion 62 of the wheel 36 is facing the strap S. In this manner, the strap S can "slip" between the driven and pinch wheels 36, 38 without restriction (or can be "pulled" by the infeed wheels 28 or the feed assembly 20).

When a fault is sensed, the clearing and reloading assembly 12 is actuated. The motor 40 rotates the driven wheel 36 (in the direction as indicated by the arrow at 70) to bring the gripper portion 66 (the second diameter) into contact with the strap S. At the same time, contact of the lever finger 54 with the engaging shoulder 56 on the driven wheel 36 rotates the lever 52 bringing the rotating cutter 42 into contact with and cutting the strap S. The strap S is held in place between the wheels 36, 38 by the spring loaded gripper 66.

Following severing of the strap S, continued downward movement of the rotating cutter 42 (e.g., continued rotation of the cutter 42) directs the strap S into the ejected strap path 50. Once the strap S is directed into the ejected strap path 50, the motor 40 stops and the infeed wheels 28 are reversed directing the strap S (that is, the strap S that is inside of the machine 10 and thus "pulled") out of the machine 10 through the ejected strap path 50. It is important to note that the action of the gripper 66 on the strap S has maintained the strap S at the clearing and reloading assembly wheels 36, 38.

Upon ejection of the faulted strap S, the infeed wheels 28 are stopped (from the reverse direction) and the drive motor 40 rotates the driven wheel 36 which in turn allows the cutter 42 to return to the home position (by action of the lever spring 58) to open the strap path 32. The driven wheel 36 continues to rotate moving the portion of the wheel at the third diameter 64 into contact with the strap S. As set forth above, in this position, the strap S is "pinched" between the driven wheel 36 and the pinch wheel 38, and rotation of the driven wheel 36 thus drives the strap S into the infeed wheels 28. The infeed wheels 28 then resume normal operation (forward-feeding direction rotation to reload the machine 10). Rotation of the clearing and reloading assembly driven wheel 36 is stopped (as by stopping the motor 40) when a home sensor 72 is activated, which senses when the first portion 62 of the wheel 36 is opposite the pinch wheel 38.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A clearing and reloading assembly for a strapping machine of the type having an infeed arrangement at about a strap material inlet to the machine, a feed assembly and a chute, the strapping machine defining a strap material holding region between the infeed arrangement and the feed assembly, the strapping machine configured to receive first and second courses of associated strap material, position, tension and seal the strap material around a load, the clearing and reloading assembly comprising:

a body;

a driven wheel mounted to the body for rotation, the driven wheel defining first, second and third peripheral portions, the second peripheral portion being movable relative to the first peripheral portion;

a bearing element mounted to the body for rotation opposite of the driven wheel, the bearing element and the driven wheel defining a strap path therebetween; and a strap cutter disposed for movement into and out of the strap path, wherein a gap is defined between the first peripheral portion and the bearing element such that the strap material can slip therebetween, wherein the strap material is gripped between the second peripheral portion and the bearing element, and wherein the strap material is pinched between third peripheral portion and the bearing element, and wherein the cutter is moved into the strap path to sever the strap material.

2. The clearing and reloading assembly in accordance with claim 1 wherein the second peripheral portion of the driven wheel engages the strap material to secure the strap material between the driven wheel and the bearing element when the cutter severs the strap material to prevent slipping of the strap material.

3. The clearing and reloading assembly in accordance with claim 1 wherein the second peripheral portion of the driven wheel is formed as a movable gripping portion movable in a radial direction.

4. The clearing and reloading assembly in accordance with claim 3 wherein the movable gripping portion is biased toward an outward radial direction.

5. The clearing and reloading assembly in accordance with claim 1 wherein the bearing element is an idler wheel.

6. The clearing and reloading assembly in accordance with claim 1 wherein the strap cutter is rotatably moveable into and out of the strap path.

7. The clearing and reloading assembly in accordance with claim 1 including a cutter engaging member operably connected to the cutter for moving the strap cutter into and out of the strap path.

8. The clearing and reloading assembly in accordance with claim 7 wherein the cutter engaging member is engageable with the driven wheel for moving the strap cutter into and out of the strap path.

9. A strapping machine of the type configured to receive first and second courses of associated strap material, position, tension and seal the strap material around a load, comprising:

an infeed arrangement having a strap material inlet;

a feed assembly;

a strap material holding region between the infeed arrangement and the feed assembly;

a chute; and a clearing and reloading assembly having a body, a driven wheel mounted to the body for rotation, the driven wheel having first, second and third portions, the second portion being movable relative to the first portion, a bearing element mounted to the body for rotation opposite the driven wheel, the bearing element and the driven wheel defining a strap path therebetween, and a strap cutter disposed for movement into and out of the strap path, wherein a gap is defined between the first portion and the bearing element such that the strap material can slip therebetween, and wherein the second portion of the driven wheel is configured such that the strap material is gripped between the second portion and the bearing element, and wherein the third portion of the driven wheel is configured such that the strap material is pinched between third portion and the bearing element, and wherein the cutter is moved into the strap path to sever the strap material.

10. The strapping machine in accordance with claim 9 wherein the second portion of the driven wheel engages the strap material to secure the strap material between the driven wheel and the bearing element when the cutter severs the strap material.

11. The strapping machine in accordance with claim 9 wherein the second portion of the driven wheel is formed as a movable gripping portion movable in a radial direction.

12. The strapping machine in accordance with claim 11 wherein the movable gripping portion is biased toward an outward radial direction.

13. The strapping machine in accordance with claim 9 wherein the bearing element is an idler wheel.

14. The strapping machine in accordance with claim 9 wherein the strap cutter is rotatably moveable into and out of the strap path.

15. The strapping machine in accordance with claim 9 including a cutter engaging member operably connected to the cutter for moving the strap cutter into and out of the strap path.

16. The strapping machine in accordance with claim 15 wherein the cutter engaging member is engageable with the driven wheel for moving the strap cutter into and out of the strap path.

17. A clearing and reloading assembly for a strapping machine of the type having an infeed arrangement at about a strap material inlet to the machine, a feed assembly and a chute, the strapping machine defining a strap material holding region between the infeed arrangement and the feed assembly, the strapping machine configured to receive first and second courses of associated strap material, position, tension and seal the strap material around a load, the clearing and reloading assembly comprising:

a body;

a driven wheel mounted to the body for rotation, the driven wheel defining first, second and third peripheral portions, the second peripheral portion being movable relative to the first peripheral portion;

a bearing element mounted to the body for rotation opposite of the driven wheel, the bearing element and the driven wheel defining a strap path therebetween; and a strap cutter and guide assembly;

wherein a gap is defined between the first peripheral portion and the bearing element such that the strap material can slip therebetween, wherein the strap material is gripped between the second peripheral portion and the bearing element, wherein the strap material is pinched between third peripheral portion and the bearing element, and wherein the strap cutter and guide element is movable to sever the strap material.

18. The clearing and reloading assembly in accordance with claim 17 wherein the driven wheel grips the strap material to secure the strap material between the driven wheel and the bearing element when the strap cutter and guide assembly severs the strap material to prevent slipping of the strap material.

19. The clearing and reloading assembly in accordance with claim 17 wherein the strap cutter and guide assembly is rotatably moveable into and out of the strap path.

20. The clearing and reloading assembly in accordance with claim 17 wherein movement of the strap cutter and guide assembly into and beyond the strap path defines a strap material ejection path.

21. The clearing and reloading assembly in accordance with claim 20 including an engaging arm operably connected to the strap cutter and guide assembly for moving the strap cutter and guide assembly into and out of the strap path.

22. The clearing and reloading assembly in accordance with claim 21 wherein the engaging arm is engageable with the driven wheel for moving the strap cutter and guide assembly into and out of the strap path.

* * * * *